US007984837B2

(12) United States Patent
Palmquist et al.

(10) Patent No.: US 7,984,837 B2
(45) Date of Patent: Jul. 26, 2011

(54) ELECTRICALLY POWERED STAPLER

(75) Inventors: Mattias Palmquist, Hestra (SE); Mats Andersson, Mullsjö (SE); Trygve Gustavsson, Åsenhöga (SE)

(73) Assignee: Isaberg Rapid AB, Hestra (SE)

( * ) Notice: Subject to any disclaimer, the term of this patent is extended or adjusted under 35 U.S.C. 154(b) by 119 days.

(21) Appl. No.: 11/912,494

(22) PCT Filed: Mar. 9, 2006

(86) PCT No.: PCT/SE2006/000301

§ 371 (c)(1), (2), (4) Date: Oct. 24, 2007

(87) PCT Pub. No.: WO2006/115444

PCT Pub. Date: Nov. 2, 2006

(65) Prior Publication Data

US 2008/0190984 A1 Aug. 14, 2008

(30) Foreign Application Priority Data

Apr. 25, 2005 (SE) ..... 0500911

(51) Int. Cl.
*B27F 7/36* (2006.01)

(52) U.S. Cl. ..... 227/7; 227/131; 227/154

(58) Field of Classification Search ..... 227/131, 227/2, 5, 7, 129, 132, 155
See application file for complete search history.

(56) References Cited

U.S. PATENT DOCUMENTS 2,500,217 A * 3/1950 Taylor, Jr. ..... 227/7
2,947,002 A 8/1960 Moore
3,282,489 A 11/1966 March
3,625,408 A * 12/1971 Amakawa et al. ..... 227/131
3,666,157 A * 5/1972 Kawai et al. ..... 227/131
3,971,969 A * 7/1976 Wines et al. ..... 361/205
4,491,260 A * 1/1985 Jimena ..... 227/2
4,589,581 A * 5/1986 Balma ..... 227/7
4,726,505 A * 2/1988 Okazaki ..... 227/132
4,811,885 A * 3/1989 Lai ..... 227/131

(Continued)

FOREIGN PATENT DOCUMENTS

GB 823 561 A 11/1959

(Continued)

*Primary Examiner* — Lindsay Low

(74) *Attorney, Agent, or Firm* — Miles & Stockbridge P.C.

(57) ABSTRACT

Stapler (1) which in the course of a reciprocating working stroke (V) staples a workpiece (4), preferably a sheaf of papers, which stapler is powered by an electric motor which, via a transmission arrangement (5) drives the stapler during the working stroke, whereby the motor is activated and initiates the working stroke from a certain starting region as a result of the workpiece moving a trigger (32,33) which forms part of a trigger device (6) to a position at which a circuit-breaker (7), which forms part of the same electrical circuit (8) as the motor is connected to, is closed by the trigger, and whereby a release arrangement (9) connected to, and operatively acted upon, by a rotating means (11) which forms part of the transmission arrangement moves the trigger during the return phase of the working stroke to a non-closing position at which the circuit-breaker returns to an open position, thereby breaking the electric circuit and deactivating the motor, with the result that the working stroke ends in the starting region, whereby the trigger (32,33), when it has been moved to close the circuit-breaker (7) and the working stroke has been initiated by the force from a first elastic means (21), remains in the position at which it closes the circuit-breaker.

3 Claims, 13 Drawing Sheets

U.S. PATENT DOCUMENTS

| | | | | |
|---|---|---|---|---|
| 5,007,572 | A * | 4/1991 | Chung-Cheng | 227/7 |
| 5,105,329 | A * | 4/1992 | Goldner | 361/156 |
| 5,195,671 | A * | 3/1993 | Shimomura et al. | 227/5 |
| 5,222,645 | A * | 6/1993 | Sueda | 227/7 |
| 5,330,086 | A * | 7/1994 | Shimomura et al. | 227/7 |
| 5,427,296 | A * | 6/1995 | Chen | 227/7 |
| 5,460,314 | A * | 10/1995 | Udagawa | 227/155 |
| 5,657,918 | A * | 8/1997 | Shimomura et al. | 227/7 |
| 5,803,337 | A * | 9/1998 | Fukai et al. | 227/7 |
| 5,806,749 | A * | 9/1998 | Chen | 227/131 |
| 6,135,337 | A | 10/2000 | Harris et al. | |
| 6,536,646 | B1 * | 3/2003 | Pinczewski et al. | 227/5 |
| 6,820,787 | B2 * | 11/2004 | Pinczewski et al. | 227/5 |
| 6,820,790 | B2 * | 11/2004 | Ura | 227/131 |
| 6,935,547 | B2 * | 8/2005 | Mochizuki | 227/131 |
| 7,543,727 | B2 * | 6/2009 | Straat et al. | 227/2 |
| 2003/0197045 | A1 * | 10/2003 | Luo | 227/2 |
| 2004/0016789 | A1 * | 1/2004 | Takada | 227/7 |
| 2004/0060959 | A1 * | 4/2004 | Ura | 227/155 |
| 2004/0064954 | A1 * | 4/2004 | Schmidt | 30/251 |
| 2004/0134963 | A1 * | 7/2004 | Mochizuki et al. | 227/131 |
| 2004/0245309 | A1 * | 12/2004 | Mochizuki et al. | 227/131 |
| 2005/0023321 | A1 | 2/2005 | Tsai | |
| 2008/0156845 | A1 * | 7/2008 | Straat et al. | 227/131 |

FOREIGN PATENT DOCUMENTS

| | | |
|---|---|---|
| GB | 2 236 974 A | 4/1991 |

* cited by examiner

V
4
2
3
8
4P
DC
7
9
5

10
11
12
42
41
40
39
38
43
36
52
51
50
53
U 13
14
46
47
37
27
35
34
32
55
36
38
49
54
33
48
44
45
P
26
25
21
20
24
23
22
19
15
16
17
18
29
28

30
15
13
31

N
M
F
36
40
32
6
A
57
21
56
30
15
13
17
29
14
9
51
33
7
54
48

N
24
37
17
11
29
14
R
21
A
36
54
7

47
23
N
13
15
30

13
21
29
14
15
M

ELECTRICALLY POWERED STAPLER

TECHNICAL FIELD

The present invention relates to a stapler which in the course of a reciprocating working stroke staples a workpiece, preferably a sheaf of papers, which stapler is powered by an electric motor which, via a transmission arrangement, drives the stapler during the working stroke, whereby the motor is activated and initiates the working stroke from a certain starting region as a result of the workpiece moving a trigger which forms part of a trigger device to a position at which a circuit-breaker, which forms part of an electrical circuit to which the motor is connected, is closed by the trigger, and whereby a release arrangement connected to and operatively acted upon by a rotating means forming part of the transmission arrangement moves the trigger, during the return phase of the working stroke, to a non-closing position at which the circuit-breaker returns to an open position, thereby breaking the electrical circuit and deactivating the motor, so that the working stroke ends in the starting region.

STATE OF THE ART

Staplers of the kind indicated above are previously known and one such is disclosed in all essentials in U.S. Pat. No. 6,135,337. However, the stapler therein described has a trigger device which comprises a circle segment disc supported for rotation about a shaft which forms part of the transmission arrangement, which disc, during parts of a revolution, is caused by a shaft wheel attached to the shaft to rotate with the shaft such a distance and to such a point that it is thereafter brought by gravity and the rotatable bearing to a position from which, when the workpiece is removed, it is brought to its initial position at which it can be activated and commence a new working stroke.

The disadvantage of that previous solution, however, is that for the trigger device to function the circle segment disc needs to be brought by gravity to the initial position, which in certain cases does not happen if the slidable bearing is for any reason blocked or the stapler is in such a position that gravity acts in an opposite direction. The situation of the disc being blocked may occur where the stapler is used for a long period in a dirty environment, e.g. in a workshop environment, and the situation of the stapler being in a position in which gravity acts in an opposite direction may occur where the stapler is built into a copier or printer and has for space reasons to be fitted facing upside down.

Problem

There is thus a need for a stapler of the kind indicated in the introduction which has a trigger device so disposed as to be unaffected by the environment in which the stapler is used and the position in which the stapler is fitted.

Proposed Solution

The present invention overcomes the disadvantages indicated above with a stapler of the kind indicated in the introduction which is characterised in that the trigger, when it has been caused to close the circuit-breaker and the working stroke has been initiated by the force from a first elastic means, is held in that position.

The present invention is further characterised in that the trigger comprises a first trigger arm and a second trigger arm, that the first arm is struck by the workpiece, that the second arm is situated between the first aim and the circuit-breaker and that the release arrangement, during the return phase of the working stroke, moves the second arm from a first position at which it is in contact with the circuit-breaker to a second position at which it is not in contact with the circuit-breaker, with the result that the circuit-breaker returns to an open position.

The present invention is still further characterised in that the second trigger arm comprises a second trigger plate which itself comprises a locking element which, when the trigger arm has moved to the second position, is itself brought to locking engagement with a recess in a first trigger plate attached to the first trigger arm and is held in that position by the force from a third elastic means, thereby preventing the second trigger arm from returning to the first position until the release arrangement has blocked the force from the first elastic means in such a way that the first trigger arm can be caused by the force from a second elastic means to return to the non-closed position, after which the second trigger arm is returned to the first position by the force from the third elastic means.

The present invention is also characterised in that the first elastic means takes the form of a helical spring.

Finally, the present invention is characterised in that the second elastic means takes the form of a helical spring.

BRIEF DESCRIPTION OF THE DRAWINGS

The present invention will be described below with reference to an example of a preferred embodiment depicted in the attached drawings, in which.

PREFERRED EMBODIMENT EXAMPLE

Figure 1:
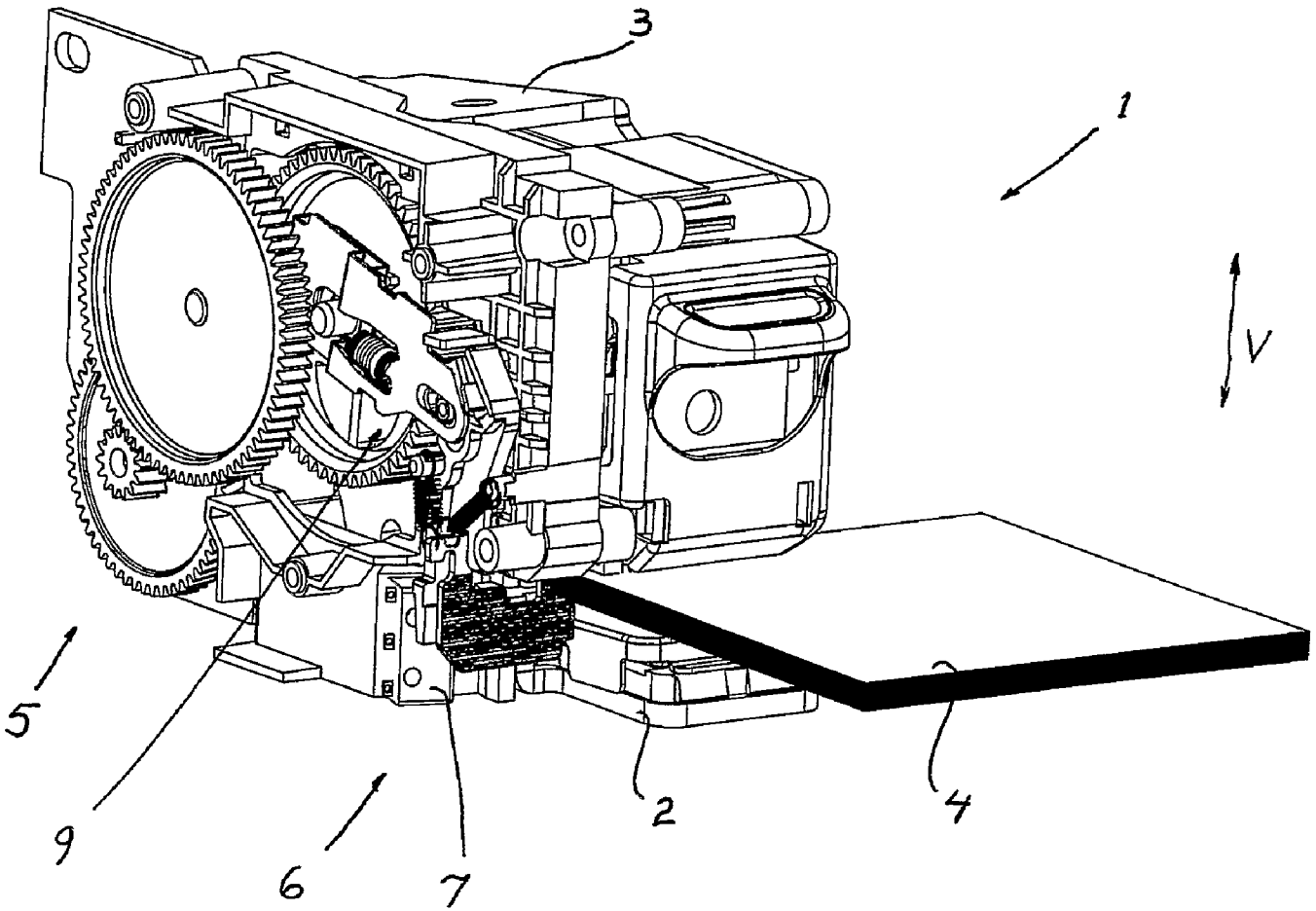
FIG. 1 is a general view of a stapler according to the present invention in which a workpiece has been placed in position for stapling.
Figure 2:
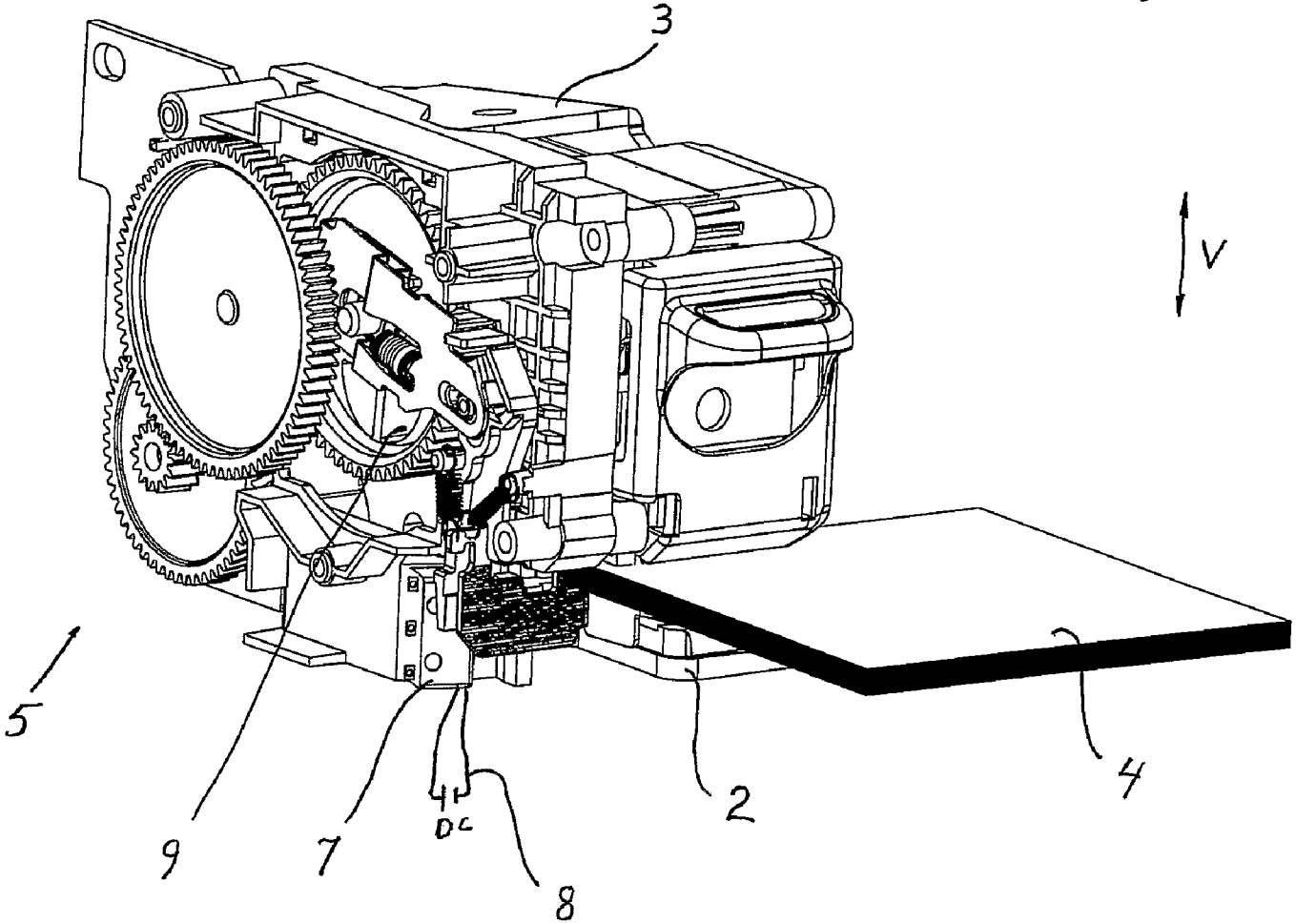
FIG. 2 is a view corresponding to FIG. 1 in which the stapler is in a position at which the working stroke has reached its bottom position.

FIGS. 1 and 2 are general views of a stapler 1 which accommodates the present invention. They show that the stapler comprises a base element 2 and a stapling head 3. A workpiece 4 for stapling is placed on the base element. The drawings also show a transmission arrangement 5 driven by an undepicted electric motor. The transmission arrangement in a known manner drives the base element and the stapling head relative to one another in a reciprocating working stroke which is indicated by the double arrow V and which has a starting region position in which the stapling head and the base element are at a distance from one another. During this working stroke, stapling of the workpiece is effected in a known manner by a staple being driven, by a driver connected to driving arms (which staple driver and driving arms are not depicted in the drawings), into the workpiece and this driving takes place, as is obvious to one skilled in the art, when the stapling head is driven down towards the base element, after which the stapling head, having reached a reversing position of the transmission arrangement, is driven in an opposite direction from the base element in order to return to its starting region position. In FIG. 1 the stapler is in its starting region position in which the stapling head is at a distance from the base element, and in FIG. 2 the stapling head is at the reversing position and in contact with the workpiece placed on the base element. The stapling head and the base element are thus driven by the transmission arrangement 5, which is itself driven by an electric motor not depicted in the drawings, in a reciprocating working stroke indicated by the double arrow V, during which working stroke a staple in a known manner is driven into, and staples, the workpiece. The drawings also show a trigger device 6 which, when stapling is to take place, is struck by the workpiece 4 and thereby caused to close an electric circuit-breaker 7, which circuit-breaker is in a known manner connected to and forms part of an electric circuit 8 very schematically depicted in FIG. 2, which circuit the electrically powered motor also forms part of, and, as will be obvious to one skilled in the art, the motor is started by the circuit-breaker being closed, with the result that the stapler performs its working stroke until the circuit-breaker and the circuit open, whereupon the working stroke ends. The drawings also show a release arrangement 9 which during the working stroke, in a manner which will be described below, releases the trigger from contact with the circuit-breaker, thereby breaking the electric circuit.

Figure 3:
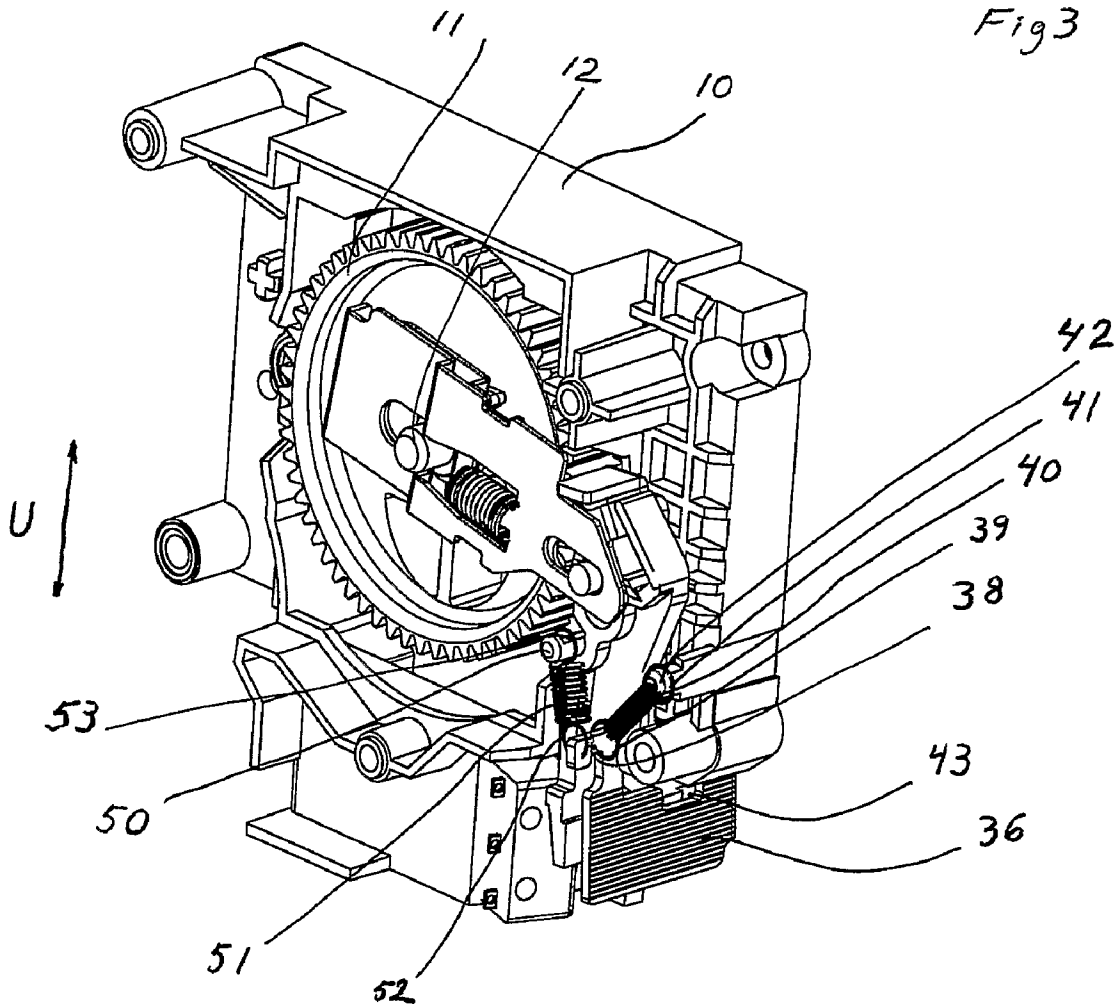
FIG. 3 is a general view showing the portions essential to the invention, as viewed obliquely from in front.
Figure 4:
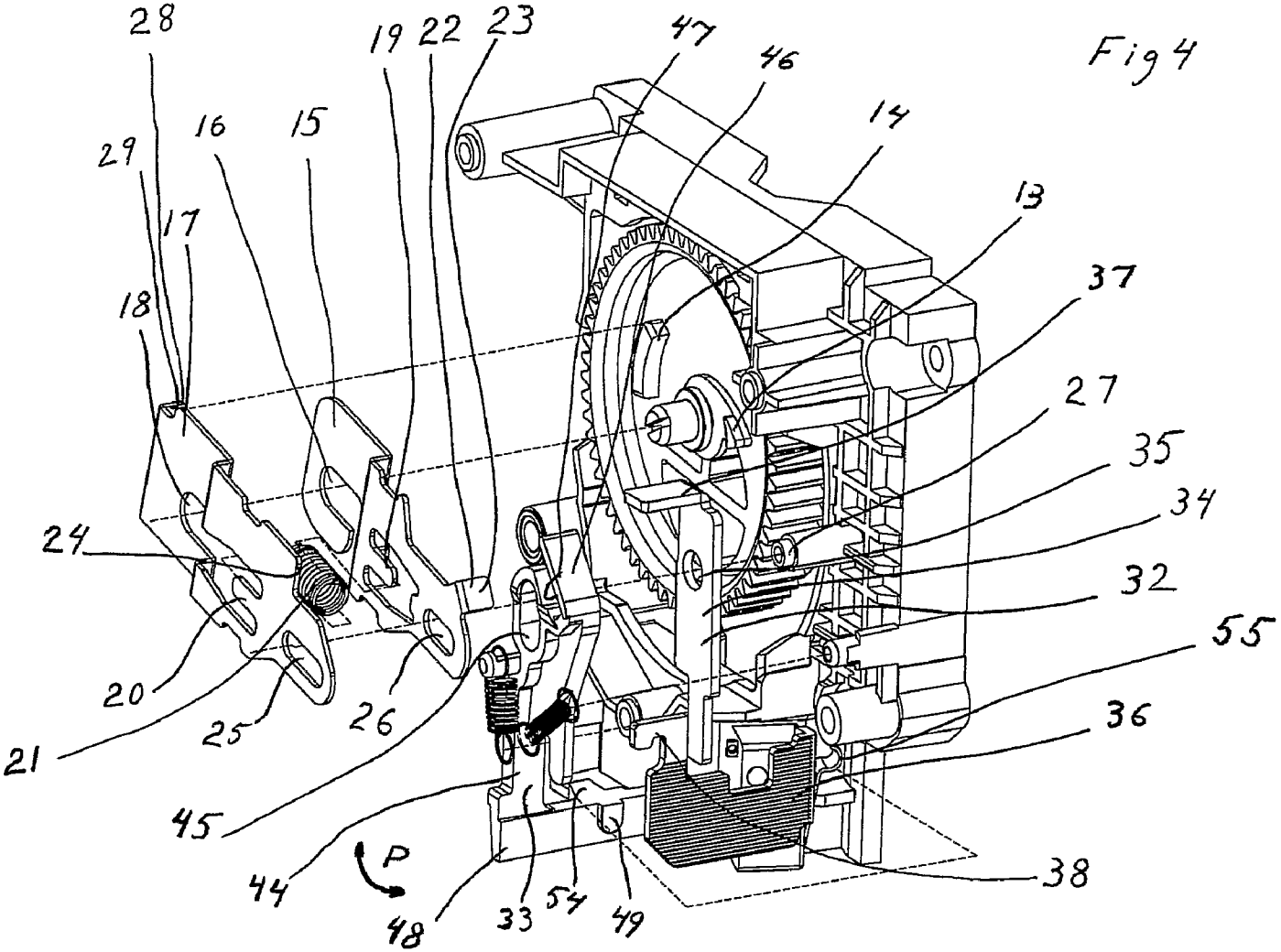
FIG. 4 is a view corresponding to FIG. 3, in an exploded version.
Figure 5:
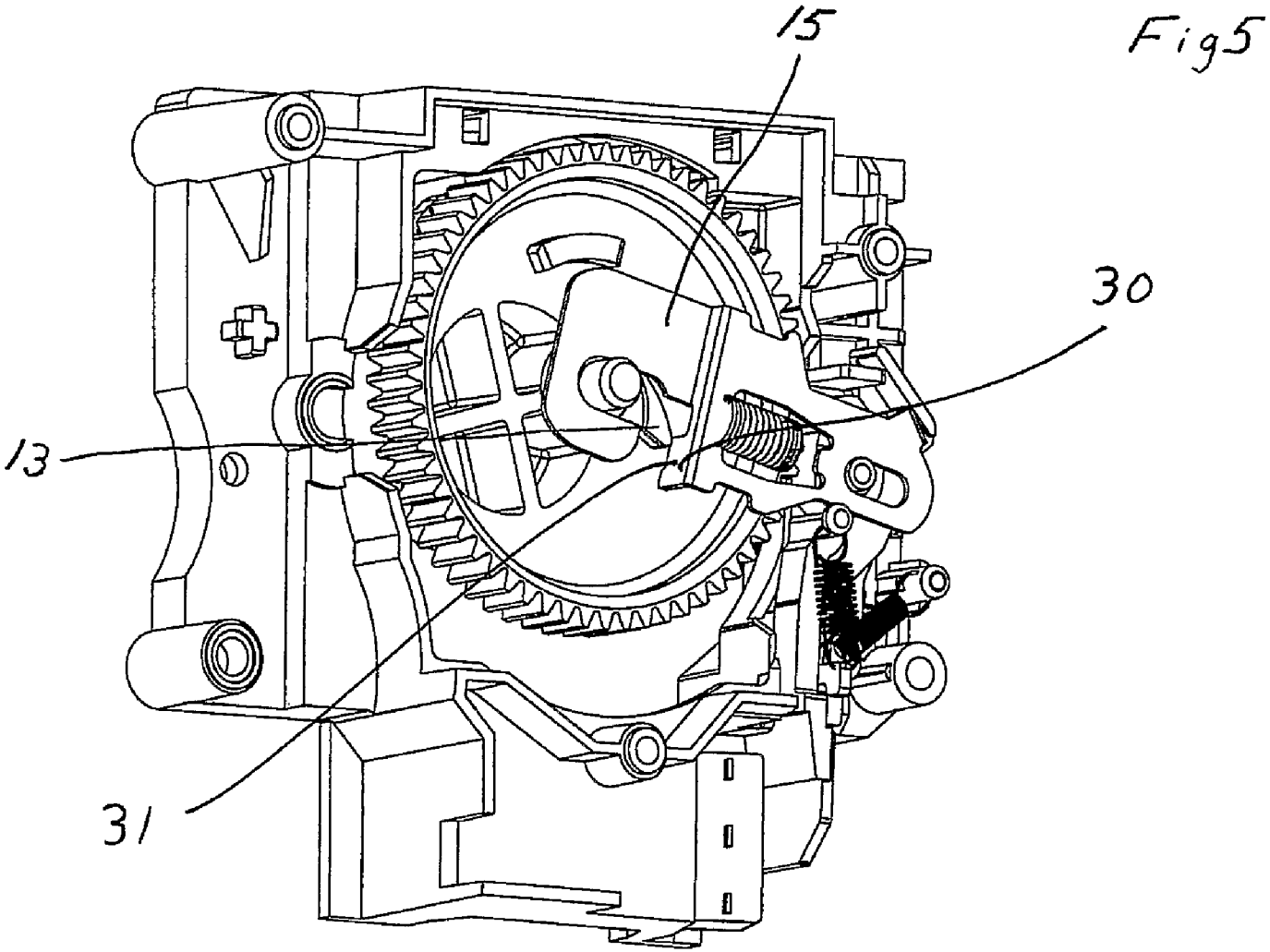
FIG. 5 is a view corresponding to FIG. 3, as seen obliquely from behind with certain portions of the release arrangement omitted.

The construction of the trigger device 6 and the release arrangement 9 will now be explained in detail with reference to FIGS. 3 and 4. These drawings show a frame portion 10 which forms part of the stapling head 3. A driving wheel 11 forming part of the transmission arrangement is supported for rotation relative to the frame portion by means of a shaft 12. The driving wheel is provided with a first cam curve 13 and a second cam curve 14. A first link arm 15 is supported relative to the shaft 12 in that the shaft extends through an oblong first aperture 16 disposed in the link arm. The aperture 16 is so disposed relative to the shaft that the shaft can move along the aperture, thereby making it possible for the link arm to move in a radial direction relative to the shaft 12. Outside the first link arm 15, a second link arm 17 is supported by means of an oblong second aperture 18 and this support is also such that the arm can move in a radial direction relative to the shaft 12. The first link arm is provided with a first spigot 19 and the second link aim with a second spigot 20. An elastic means 21 is disposed between the spigots 19 and 20, in the form of a helical spring which connects the first and second link arms in that each of the spigots extends into the helical spring from its respective side. The first link arm 15 has at its front edge a first flange 22 which itself has a slide surface 23 whose function will be indicated in the description below. The second link arm has at its front edge an abutment shoulder 24 whose function will likewise be indicated in the description below. Each of the link alms also has at its front edge an oblong slot 25, 26 respectively, which are each coupled to a spigot 27 attached to the frame 10 and are so disposed that the slots slide along the spigot when, as will be described below, the link arms move in a radial direction relative to, and along, the shaft spigot 12. The second link arm 17 is provided at the rear edge with a notch 28 which has a first contact surface 29 which, in a manner which will be described below, cooperates with the second cam curve 14. FIG. 5 shows the first link aim 15 provided with a flange 30 which has a second contact surface 31 which cooperates with the first cam curve 13, which cooperation will be described below. FIGS. 3 and 4 also show a first trigger arm 32 and a second trigger aim 33. The first trigger arm comprises an elongate member 34 provided with a hole 35 by means of which the member is supported for pivoting relative to the spigot 27, and the fact that the hole 35 is somewhat larger than the spigot 27 means that the trigger aim can pivot about the spigot 27 in the direction indicated by the arcuate double arrow P. A first trigger plate 36 is disposed at the lower edge of the member and a contact link 37 is disposed at the upper edge of the member. The trigger plate 36 is provided with a hook means 38 to which is connected a first end 39 of a second elastic means 40 in the form of a helical spring which has its second end 41 connected to a pin 42 disposed in the frame when the trigger arm 32 is fitted to the spigot 27. The trigger plate 36 is further provided with a recess 43 whose function will be indicated in the description below. The second trigger arm 33 comprises a second elongate member 44 provided with a third oblong aperture 45 which extends in the longitudinal direction of the member. The trigger aim 33 is fitted to the spigot 27 by the oblong aperture 45 being moved onto the spigot 27. The trigger arm can move up and down on the spigot 27 in the direction indicated by the double arrow U and in the direction indicated by the double arrow P. The upper portion of the trigger arm is provided with an extension 46 which has a sliding plane 47 which, as will be indicated below, cooperates with the slide surface 23. The lower portion of the second trigger aim 33 is provided with a second trigger plate 48 which has a locking element 49. The second trigger arm is also provided with a peg 50. A third elastic means 51 in the form of a helical spring is connected by a first loop 52 to the hook means 38 and by a second loop 53 to the peg 50 when the second trigger arm is fitted to the spigot 27. The trigger plate 48 is provided with a thrust spigot 54 which, when the trigger arm is fitted to the spigot 27, is in contact with a breaker arm 55 forming part of the electric circuit-breaker 7 which in a known manner is fitted to the frame 10.

Figure 6:
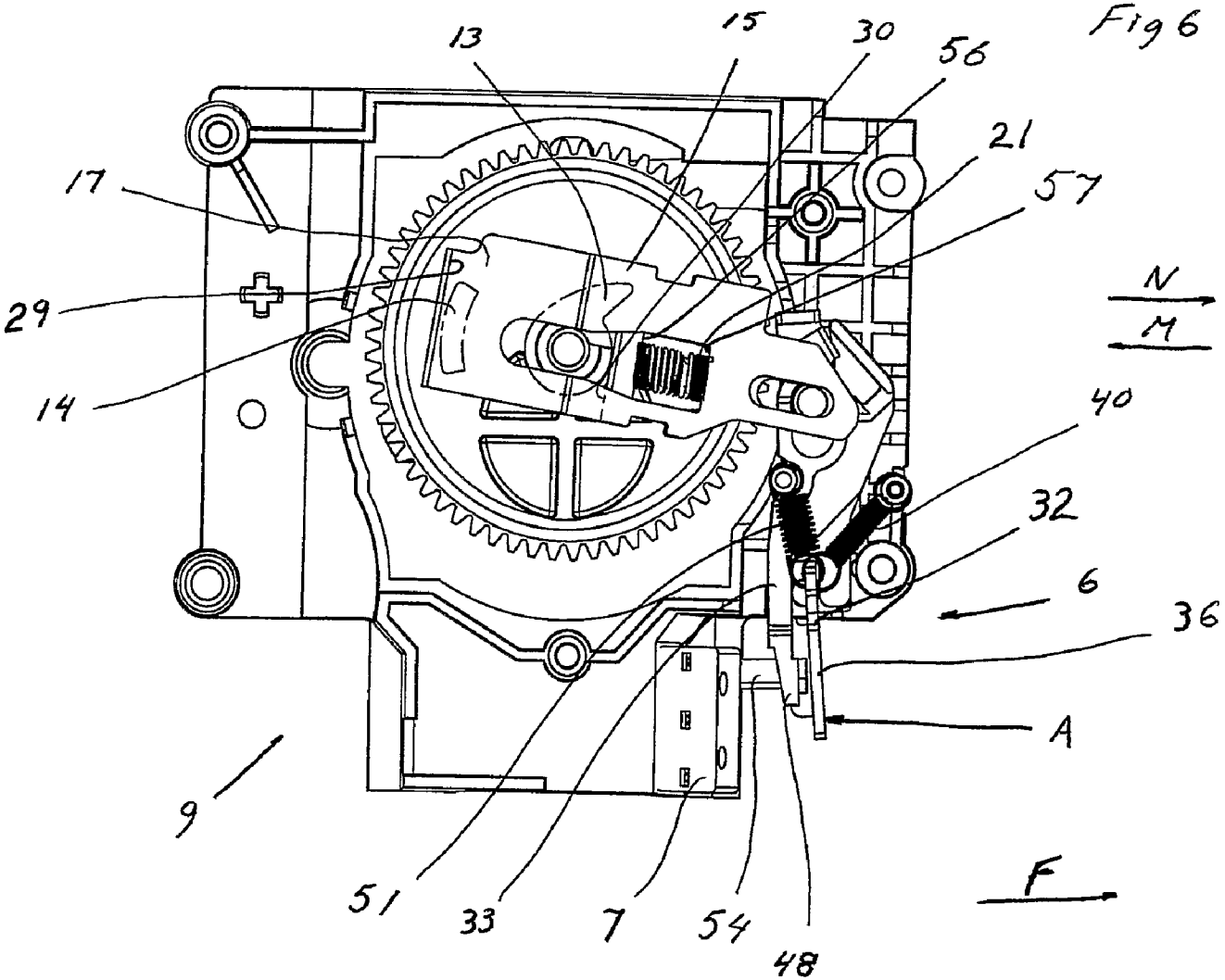
FIGS. 6-10 are general views of portions essential to the invention, referred to in various sequences of a working stroke.
Figure 7:
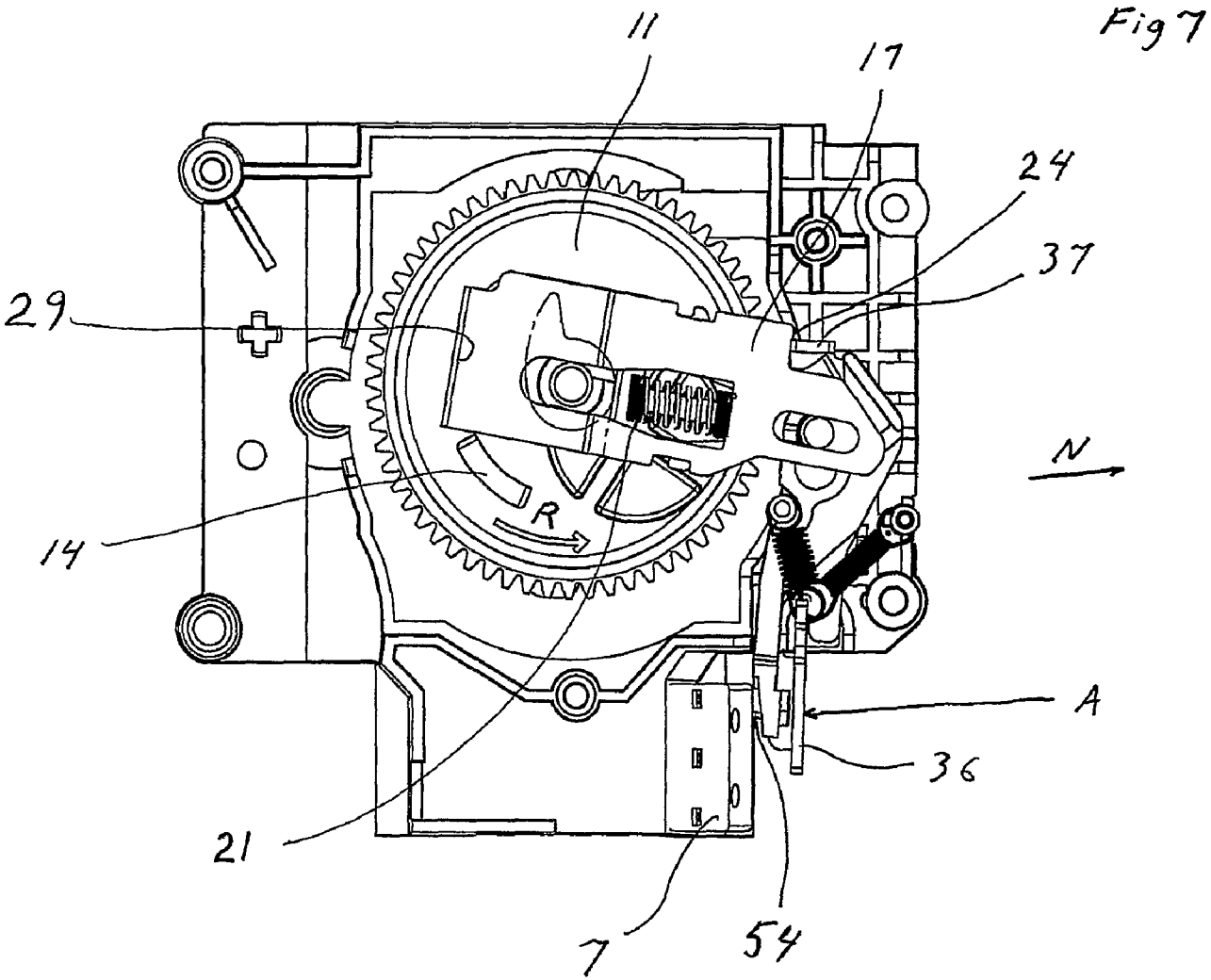
Figure 8:
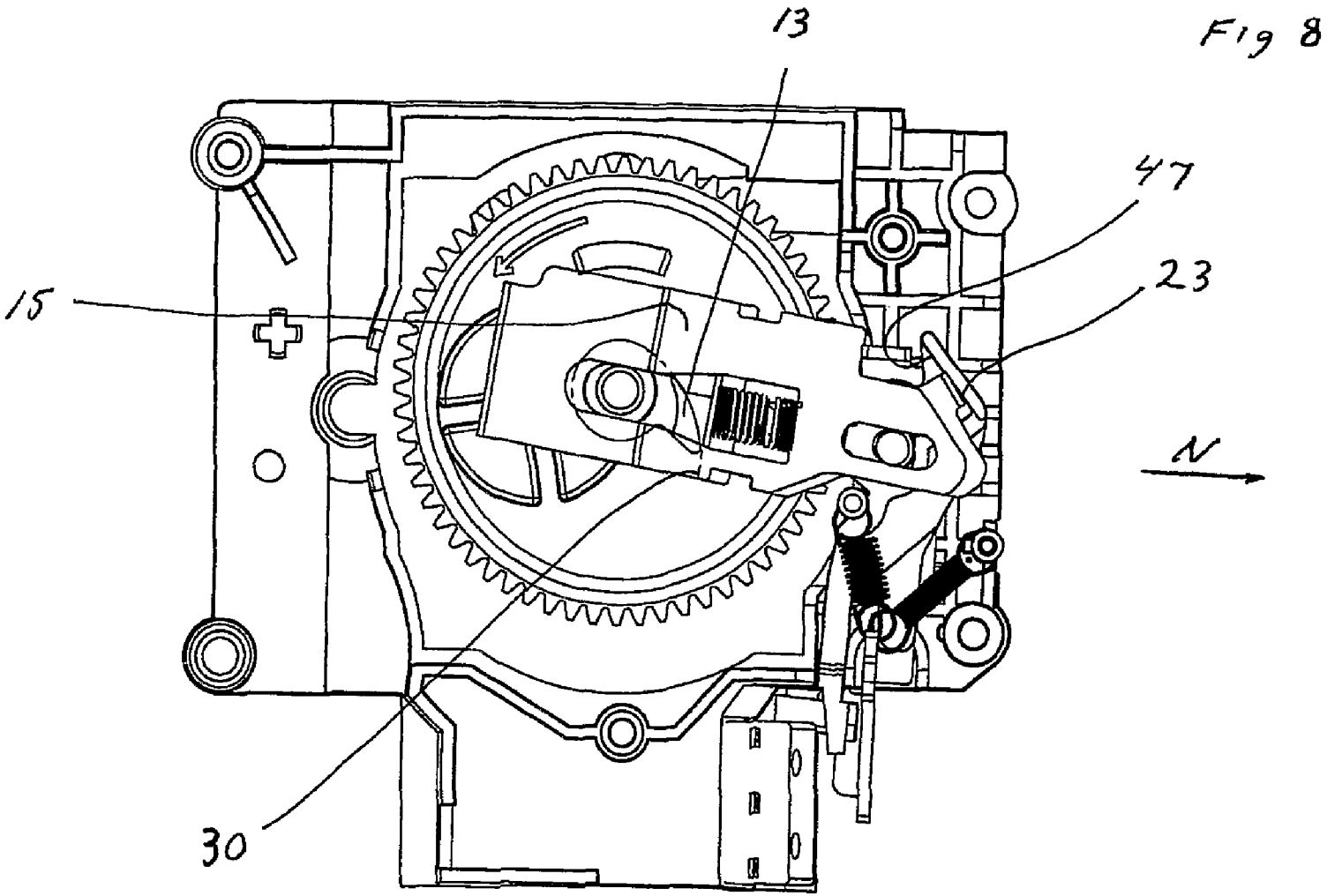
Figure 9:
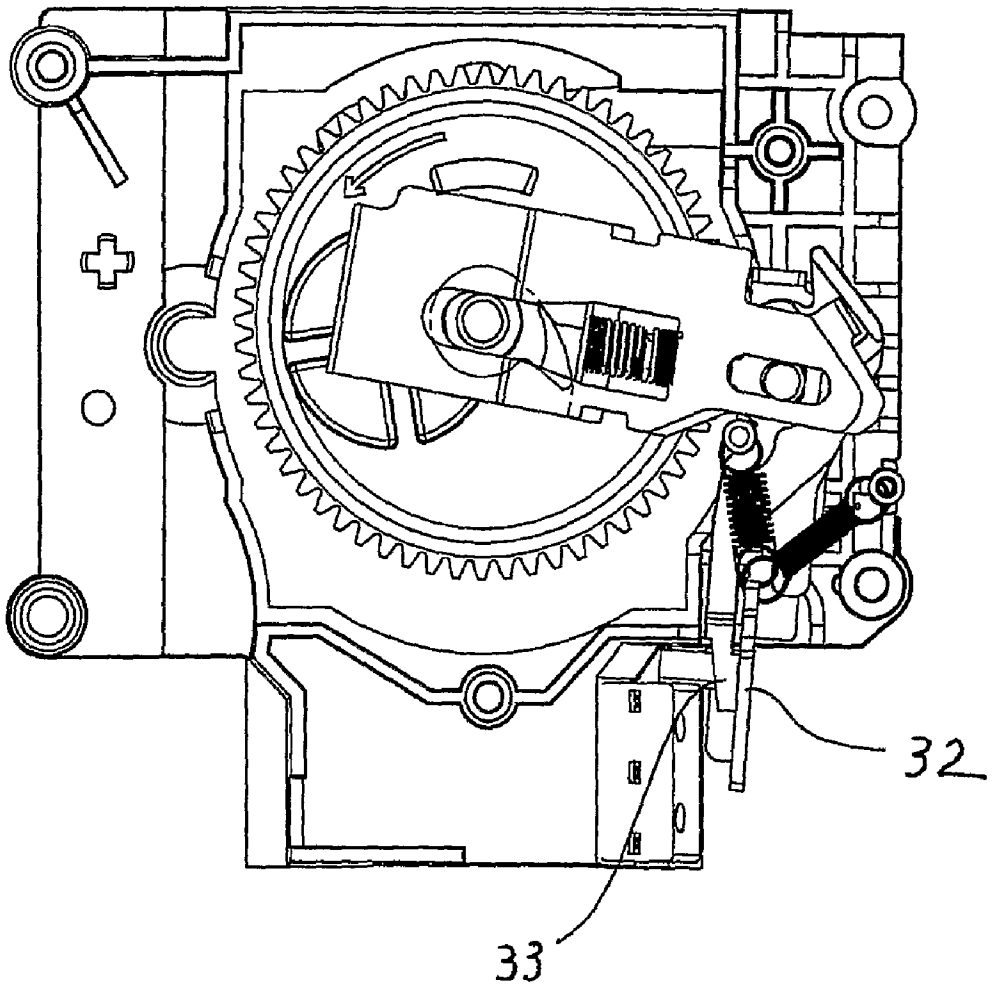
Figure 10:
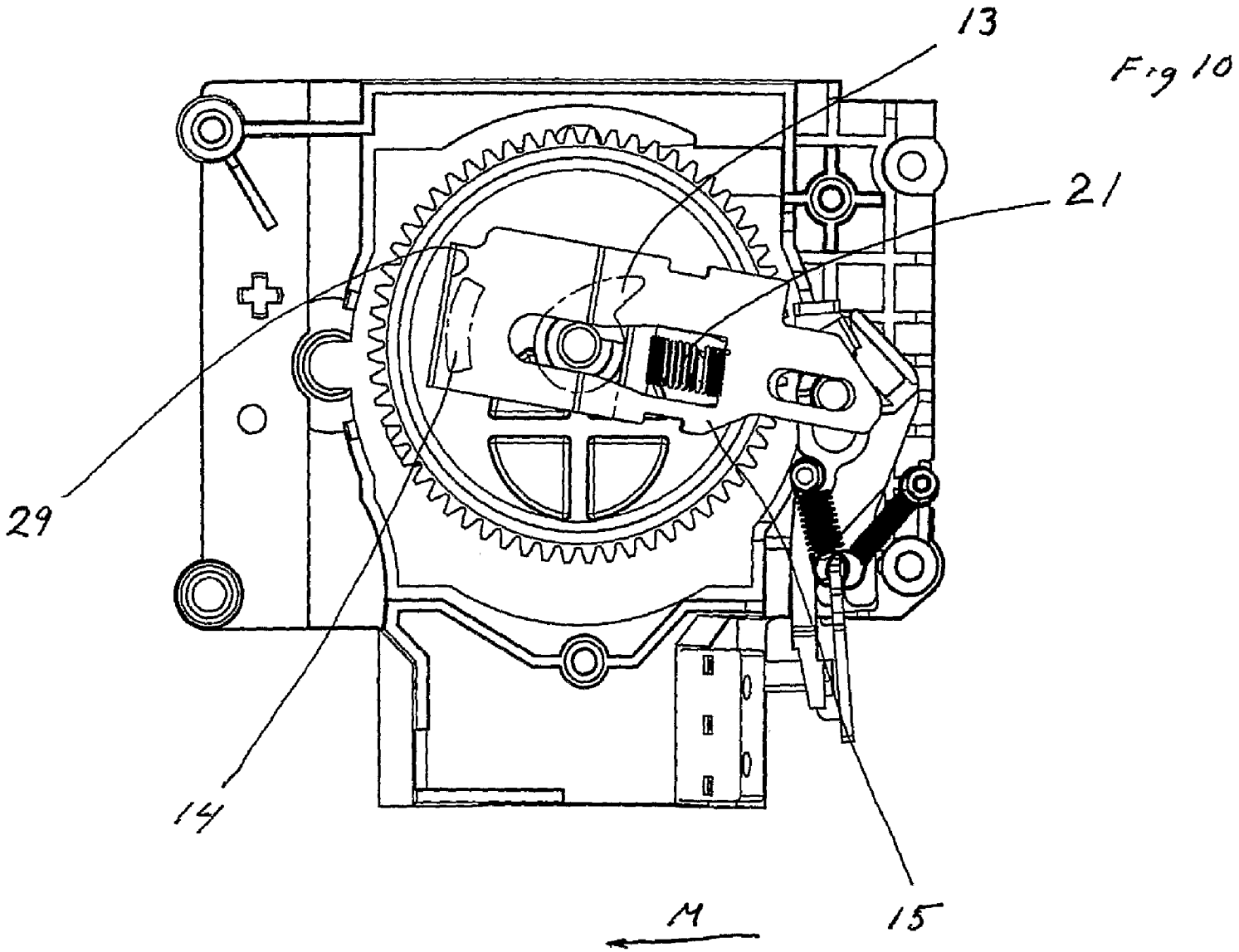
Figure 11:
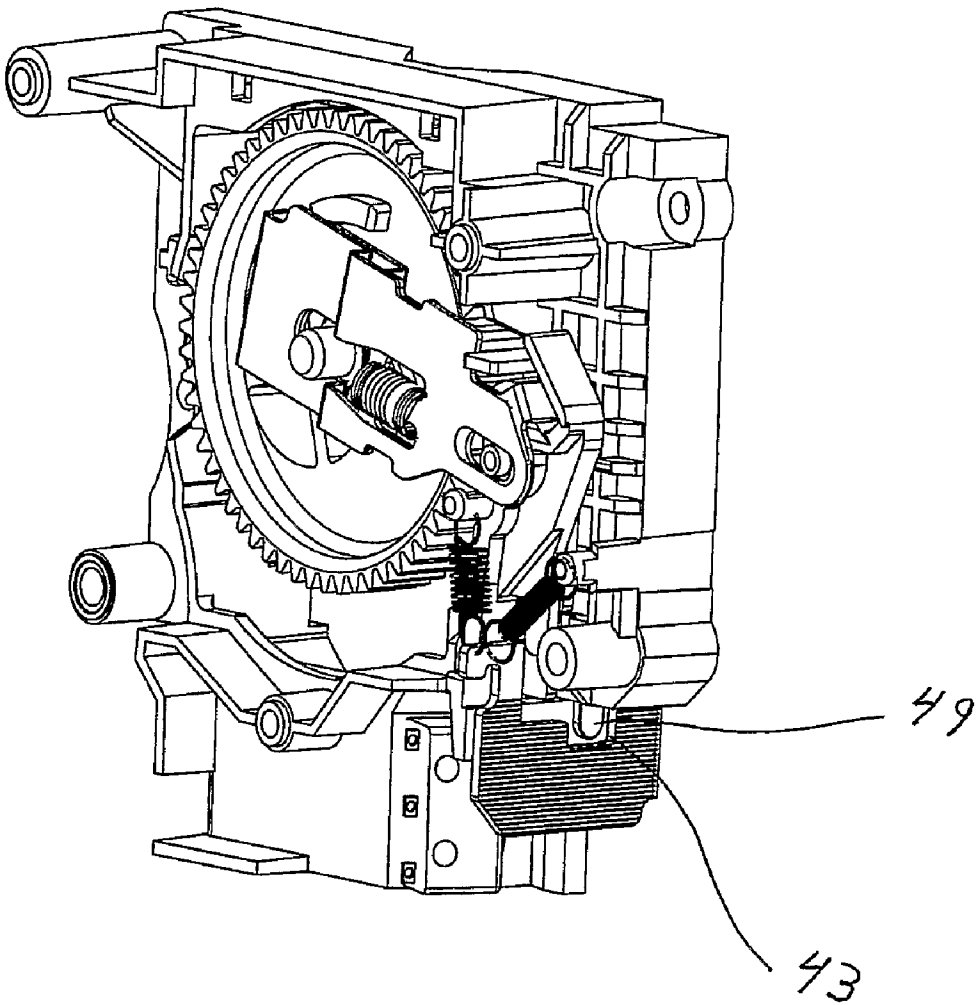
FIG. 11 is a general view showing the cooperation between the first and second portions of the trigger which forms part of the invention.
Figure 12:
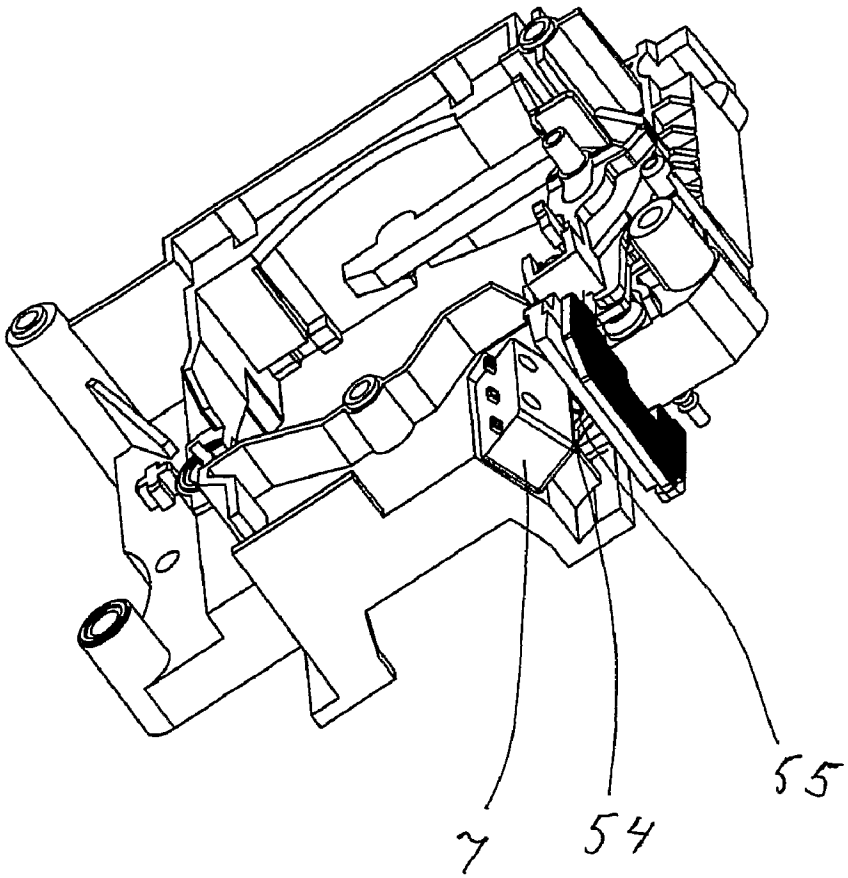
FIGS. 12-13 are views showing the cooperation of the trigger which forms part of the invention with the circuit-breaker which forms part of the invention.
Figure 13:
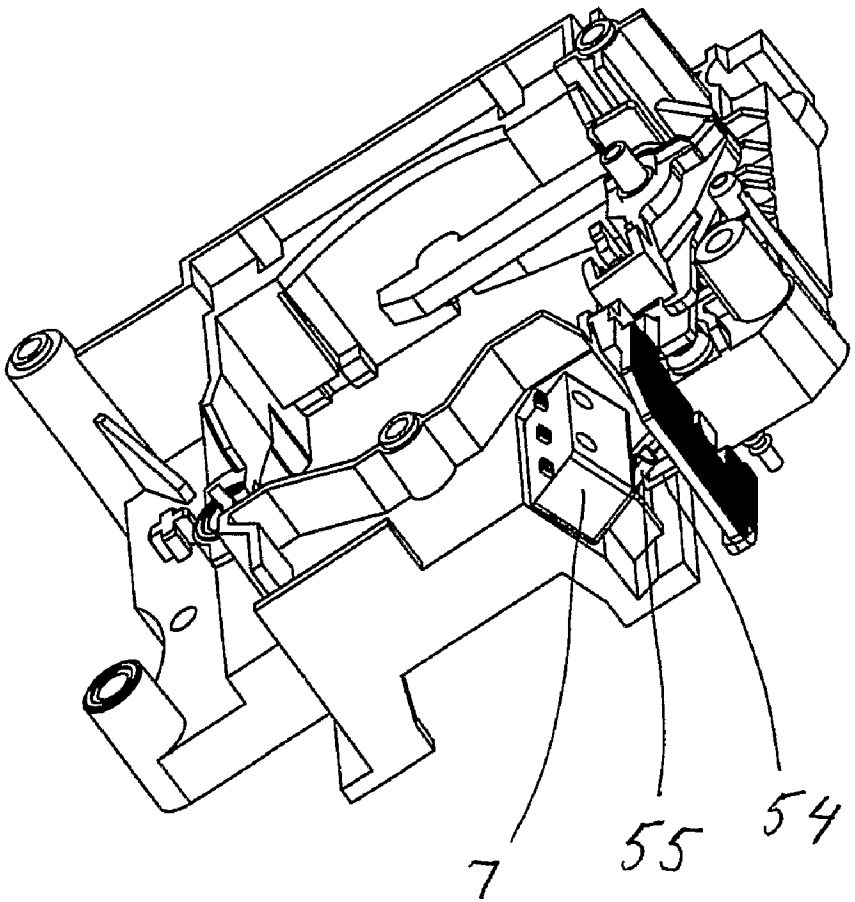

The function of the trigger device and the release arrangement are described below in detail with reference to FIGS. 5-13. In FIG. 6 the trigger device 6 and the arrangement 9 are in the position at which they are when the stapler is in its starting region. In this situation the first trigger arm 32 is moved by the second elastic means 40 in the direction indicated by the arrow F. The second trigger arm 33 is also moved by the third elastic means in the direction indicated by the arrow F. In this situation the thrust spigot 54 is in such a position that the breaker arm 55 is not applied (this is not depicted in the drawings), so the circuit-breaker is in an open position whereby there is no power supply to the electric motor. The second link arm 17 of the release arrangement is in contact via the contact surface 29 with the second cam curve 14 (which is depicted in broken lines), thereby preventing the link arm 17 from moving in the direction indicated by the arrow N. The first link arm 15 is in contact via the flange 30 with the first cam curve 13 (cam and flange both depicted in broken lines), thereby preventing the first elastic means 21, which in this situation is tensioned and in contact with a first seat 56 on the first link arm and a second seat 57 on the second link arm, from moving the first link arm in the direction M, which is the opposite direction to the direction N. This arrangement results in the means 21 endeavouring to move the arms 15 and 17 away from one another. A workpiece which is to be stapled strikes the first trigger plate 36, as indicated by the arrow A, and the trigger plate moves, together with the second trigger plate 48, in the direction A, thereby causing the thrust spigot 54 to move the breaker arm 55 to close the circuit-breaker, as illustrated in FIG. 12, with the result that the motor starts and, via the transmission arrangement, rotates the driving wheel 11 in the direction indicated by the arrow R. At the same time, the second elastic means 40 is tensioned. When the wheel rotates, the cam curve 14 moves and the contact between the cam curve and the contact surface 29 ceases, with the result that the means 21 moves the arm 17 in the direction N so that the abutment shoulder 24 comes into contact with the contact link 37, and the fact that the tensile force with which the means 21 is loaded is greater in that direction than the force with which the means 40, when tensioned, is loaded in an opposite direction results in the trigger arms being held in the position in which the circuit-breaker is closed. When the motor has driven the stapler in the course of the working stroke to the situation in which the wheel has rotated to the position depicted in FIG. 8, the working stroke is in its return phase and the first cam curve 13 pushes the flange 30 on the first link arm 15 in the direction N. When the link arm 15 moves in the direction N, the slide surface 23 comes into contact with the slide plane 47 of the second trigger arm 33 and the trigger arm 33 moves upwards, thereby taking the thrust spigot 54 out of engagement with the breaker arm 55 (as illustrated in FIG. 13) and hence bringing the circuit-breaker 7 to an open position and breaking the electric circuit 8, with the result that the motor stops. When the trigger arm has moved up, the third elastic means 51 is tensioned and pulls the second trigger arm 33 towards the first trigger arm 32, with the result that the locking element 49 is inserted in the recess 43 as depicted in FIGS. 9 and 11, thereby securing the second trigger arm 33 in this raised position. Owing to the rotational torque which the motor has at the time when the electric current is disconnected, the motor continues to rotate and the working stroke returns to the starting region as depicted in FIG. 10, in which region the cam curve 14 returns to engagement with the contact surface 29, with the result that the second link arm 17 returns to its starting position and at the same time the first cam curve 13 reaches the position at which the means 21 can push the first link arm 15 in the direction M, thereby causing the trigger arms to cease to be acted upon by the link arms 15 and 17 respectively, with the result that the second elastic means 40 moves the first trigger arm 32 to its original position while at the same time the third elastic means 51 moves the second trigger arm 33 to its original position.

The trigger being acted upon and held in the position at which the circuit-breaker is closed by an elastic means provides assurance that the trigger will hold the circuit-breaker in a closed position irrespective of the orientation of the stapler.

The fact that the release arrangement moves the trigger device to a position such that the circuit-breaker is brought to an open position despite the workpiece holding the trigger plates in a pushed-in position provides assurance that the stapler will not perform more than one stroke when the workpiece moves the trigger to the position at which the circuit-breaker closes.

The invention claimed is:

1. A stapler, which, in the course of a reciprocating working stroke, staples a workpiece, wherein the stapler has a transmission adapted to be driven by an electric motor and has a motor-drive circuit including a circuit-breaker closed by a trigger to initiate the working stroke from a starting position as a result of the workpiece acting on the trigger, wherein the transmission includes a wheel adapted to rotate in only one direction through 360°, that commences rotation when the circuit-breaker is closed by the trigger, wherein the wheel is operatively connected to a mechanism of the transmission that includes a first spring, wherein initial rotation of the wheel controls the mechanism of the transmission to allow a circuit-breaker closing force of the first spring to keep the circuit-breaker closed, even if the workpiece is no longer acting on the trigger, until rotational movement of the wheel, during a return phase of the working stroke to the starting position, approaches completion of one revolution, whereupon the mechanism of the transmission is controlled by the wheel to block the circuit-breaker closing force of the first spring, so that the circuit-breaker can be opened.

2. A stapler according to claim 1, wherein the trigger comprises a first trigger arm and a second trigger arm, wherein the first trigger arm is disposed to be struck by the workpiece at an original position and the second trigger arm is situated between the first trigger arm and the circuit-breaker and is disposed to be moved from an initial position to a position at which it contacts and closes the circuit-breaker, wherein, during the return phase of the working stroke, the mechanism of the transmission the second trigger arm away from the circuit-breaker contacting position to a circuit-breaker non-contacting position, so that the circuit-breaker is opened.

3. A stapler according to claim 2, wherein the second trigger arm has a second trigger plate with a locking element, which, when the second trigger arm is moved away from the circuit-breaker contacting position, is brought into locking engagement with a recess in a first trigger plate attached to the first trigger arm by the force from a third spring, and the second trigger arm is prevented from returning to the initial position until the mechanism of the transmission has blocked the force from the first spring, and the force from a second spring causes the first trigger arm to return to the original position, whereupon the force from the third spring causes the second trigger arm to return to the initial position.

* * * * *